US010908542B2

(12) United States Patent
Funaba

(10) Patent No.: US 10,908,542 B2
(45) Date of Patent: Feb. 2, 2021

(54) IMAGE FORMING APPARATUS WITH MULTIPLE POWER SOURCES AND RECOVERY FROM A SLEEP STATE

(71) Applicant: CANON KABUSHIKI KAISHA, Tokyo (JP)

(72) Inventor: Hiroshi Funaba, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/674,350

(22) Filed: Nov. 5, 2019

(65) Prior Publication Data

US 2020/0150572 A1 May 14, 2020

(30) Foreign Application Priority Data

Nov. 13, 2018 (JP) ..... 2018-212742

(51) Int. Cl.
*G03G 15/20* (2006.01)
*G03G 15/00* (2006.01)

(52) U.S. Cl.
CPC ..... *G03G 15/5004* (2013.01); *G03G 15/20* (2013.01); *G03G 15/205* (2013.01); *G03G 15/80* (2013.01)

(58) Field of Classification Search
CPC ... G03G 15/5004; G03G 15/80; G03G 15/205
USPC ..... 399/88, 70; 219/216
See application file for complete search history.

(56) References Cited

U.S. PATENT DOCUMENTS

| | | | | |
|---|---|---|---|---|
| 8,265,512 | B2 * | 9/2012 | Endo | G03G 15/2039 399/88 |
| 9,342,017 | B2 | 5/2016 | Koseki et al. | G03G 15/5004 |
| 2007/0127943 | A1 * | 6/2007 | Kowari | G03G 15/5004 399/88 |
| 2012/0155910 | A1 * | 6/2012 | Sato | G03G 15/80 399/88 |
| 2013/0207484 | A1 * | 8/2013 | Okuzono | G06F 1/3209 307/115 |
| 2014/0198337 | A1 * | 7/2014 | Nakajima | G03G 15/5004 358/1.14 |
| 2016/0011558 | A1 * | 1/2016 | Choho | G06F 1/3284 399/88 |
| 2017/0003641 | A1 * | 1/2017 | Suzuki | H02M 3/33507 |
| 2017/0068204 | A1 * | 3/2017 | Koizumi | G03G 15/5004 |

FOREIGN PATENT DOCUMENTS

| | | | |
|---|---|---|---|
| JP | 2005202355 A | * | 7/2005 |
| JP | 2008152098 A | * | 7/2008 |
| JP | 2015106002 A | * | 6/2015 |

* cited by examiner

*Primary Examiner* — Robert B Beatty
(74) *Attorney, Agent, or Firm* — Venable LLP

(57) ABSTRACT

During a period of a low power state, an image forming apparatus causes a system controller to stop an operation of a second power source and cut off voltage supply from a first power source to each of a power relay, an AC voltage detector, a fixing controller, and a printer controller. At a time of return from the low power state, the system controller starts the power supply from the first power source to each of the power relay, the AC voltage detector, the fixing controller, and the printer controller, and then activates the second power source.

8 Claims, 4 Drawing Sheets

IMAGE FORMING APPARATUS WITH MULTIPLE POWER SOURCES AND RECOVERY FROM A SLEEP STATE

BACKGROUND OF THE INVENTION

Field of the Invention

The present disclosure relates to an electrophotographic image forming apparatus such as a copying machine, a laser printer, or a multifunctional printer.

Description of the Related Art

Due to an increasing energy-saving demand, it is required to reduce power consumed by an electronic device under a plug-in OFF state, in which a main switch of the electronic device is in an OFF state, or under a sleep state. For such an electronic device, it is important to reduce a start-up time from turning ON of the main switch (i.e., plug-in ON) and a recovery time from the sleep state.

Also in an image forming apparatus, in order to reduce power consumed under the plug-in OFF state or the sleep state, the number of components to which power is supplied under such a state is minimized. To suppress an increase in power consumption resulting from deterioration of efficiency during AC-DC conversion, there has been proposed an image forming apparatus including a first power source configured to supply power during a period of a low power state and a second power source configured to stop output of power during the period of the low power state (U.S. Pat. No. 9,342,017 B2). When the first power source and the second power source are combined, power is supplied from the second power source to components consuming high power (components directly related to image formation).

When power to the components directly related to image formation is entirely supplied from the second power source, the second power source is activated, and then the power supply to such components is started. Accordingly, it takes time for the components directly related to image formation to reach an operable state. In particular, a circuit configured to control power supply to a fixing device also starts to operate after the second power is started up. Accordingly, it takes time to raise a temperature of the fixing device to a predetermined level. The present disclosure has been made in view of the problem described above, and a primary object of the present disclosure is to provide an image forming apparatus which is promptly activated from a low power state.

SUMMARY OF THE INVENTION

An image forming apparatus, which has, as states in which no image formation is performed, a low power state and a ready state in which consumed power is higher than consumed power in the low power state, the image forming apparatus comprising: a first power source configured to operate under each of the low power state and the ready state; a second power source configured to not operate under the low power state, and configured to operate under the ready state; a fixing device configured to generate heat by being supplied with power from a commercial power source; a fixing control circuit provided between the commercial power source and the fixing device and configured to control supply of the power to the fixing device; a first controller configured to operate with a voltage from the first power source to control the fixing control circuit so that a temperature of the fixing device is maintained in a target temperature; and a second controller configured to stop, under the low power state, the operation of the second power source and cut off supply of the voltage from the first power source to each of the fixing control circuit and the first controller, and start, at a time of return from the low power state to the ready state, activation of the second power source and start the voltage supply from the first power source to each of the fixing control circuit and the first controller even if the activation of the second power source is not completed.

Further features of the present invention will become apparent from the following description of exemplary embodiments (with reference to the attached drawings).

DESCRIPTION OF THE EMBODIMENTS

Figure 1:
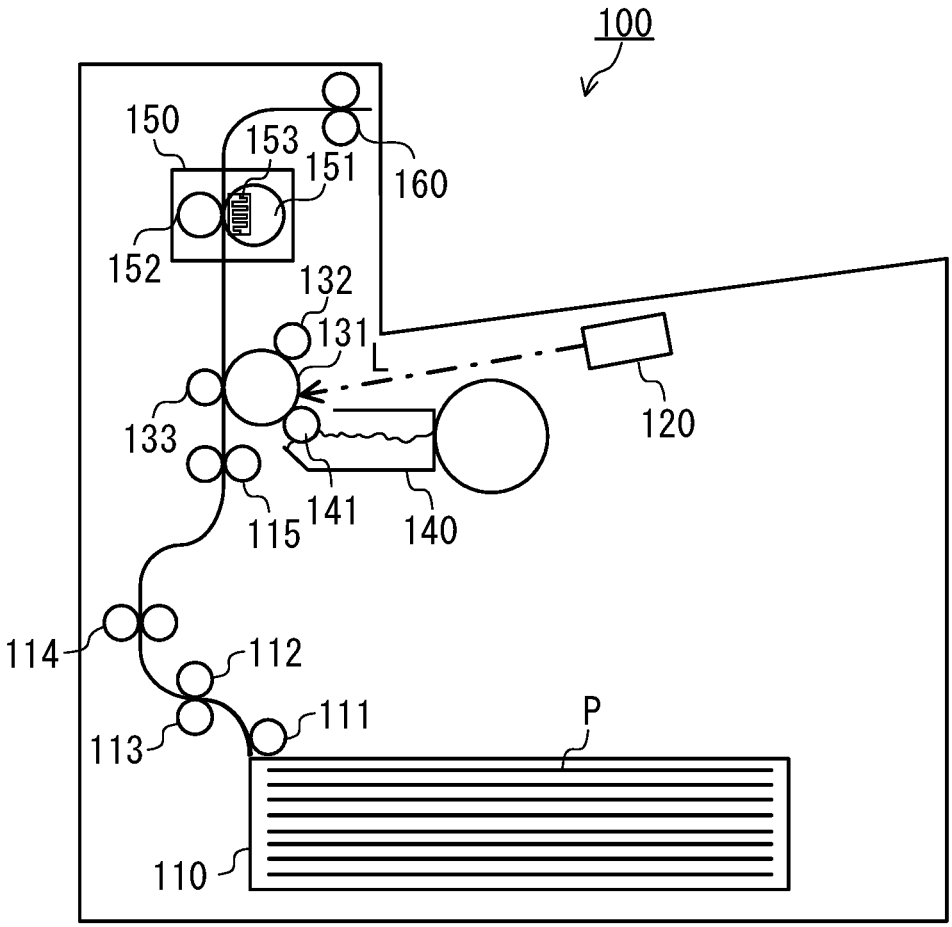
FIG. 1 is a configuration diagram of a printer according to at least one embodiment of the present disclosure.

Referring to the drawings, an image forming apparatus according to at least one embodiment of the present disclosure is described.

FIG. 1 is a configuration diagram of a printer corresponding to an image forming apparatus according to at least one embodiment.

A printer 100 includes a sheet feeding cassette 100 configured to contain sheets P. Each of the sheets P is fed from the sheet feeding cassette 110. The printer 100 includes, along a conveyance path for conveying the sheets P, a pickup roller 111, a sheet feeding roller 113, a retard roller 112, a conveying roller pair 114, a registration roller pair 115, and delivery rollers 160. The pickup roller 111 picks up the sheets P from the sheet feeding cassette 110 into the conveyance path. The sheet feeding roller 113 and the retard roller 112 separate the sheets P picked up by the pickup roller 111 from each other to allow each of the sheets P to be conveyed along the conveyance path. The conveying roller pair 114 conveys every one of the separated sheets P to the registration roller pair 115.

When the sheet P is conveyed by the conveying roller pair 114, the registration roller pair 115 is stopped. A leading end portion of the sheet P bumps into a nip portion between the stopped registration roller pair 115, and the conveying roller pair 114 conveys a predetermined amount of the sheet P. This corrects skew feeding of the sheet P in a conveyance direction thereof. The registration roller pair 115 starts to rotate at a predetermined time after the correction of the skew feeding of the sheet P, to thereby resume the conveyance of the sheet P.

The printer 100 is configured to form an image in synchronization with the feeding of the sheet P from the sheet feeding cassette 110. For this purpose, the printer 100 includes an image forming unit including a photosensitive drum 131 serving as a photosensitive member, a charging roller 132, a laser scanner unit 120, and a developing device 140. The charging roller 132 is configured to uniformly charge an outer peripheral surface of the photosensitive drum 131 to a potential having a predetermined polarity. The laser scanner unit 120 is configured to scan the uniformly charged outer peripheral surface of the photosensitive drum 131 with a laser beam L modulated based on a time-series digital pixel signal representing an image to be formed. Consequently, on the outer peripheral surface of the photosensitive drum 131, an electrostatic latent image based on the time-series digital pixel signal is formed. The developing device 140 includes a developing roller 141. The developing device 140 uses the developing roller 141 to develop the electrostatic latent image formed on the photosensitive drum 131 with toner. As a result, a toner image is formed on the outer peripheral surface of the photosensitive drum 131.

At a position facing the photosensitive drum 131 across the conveyance path for the sheets P, a transfer roller 133 is provided. In synchronization with conveyance of the toner image formed on the photosensitive drum 131 to the transfer roller 133, which is allowed by rotation of the photosensitive drum 131, the sheet P is conveyed by the registration roller pair 115 to a position between the photosensitive drum 131 and the transfer roller 133. To the transfer roller 133, a transfer bias having a polarity opposite to that of the photosensitive drum 131 is applied to allow the toner image on the photosensitive drum 131 to be transferred onto the conveyed sheet P.

The printer 100 includes a fixing device 150. The fixing device 150 includes a fixing film 151, in which a fixing heater 153 configured to generate heat is embedded, and a pressure roller 152. To a nip portion formed between the fixing film 151 and the pressure roller 152, the sheet P on which the toner image is transferred is conveyed. The sheet P is heated by the fixing heater 153 and pressurized by the fixing film 151 and the pressure roller 152, with the result that the toner image is melted by heat to be fixed. The sheet P to which the toner image is fixed is discharged by the delivery rollers 160 to the outside of the apparatus.

Figure 2:
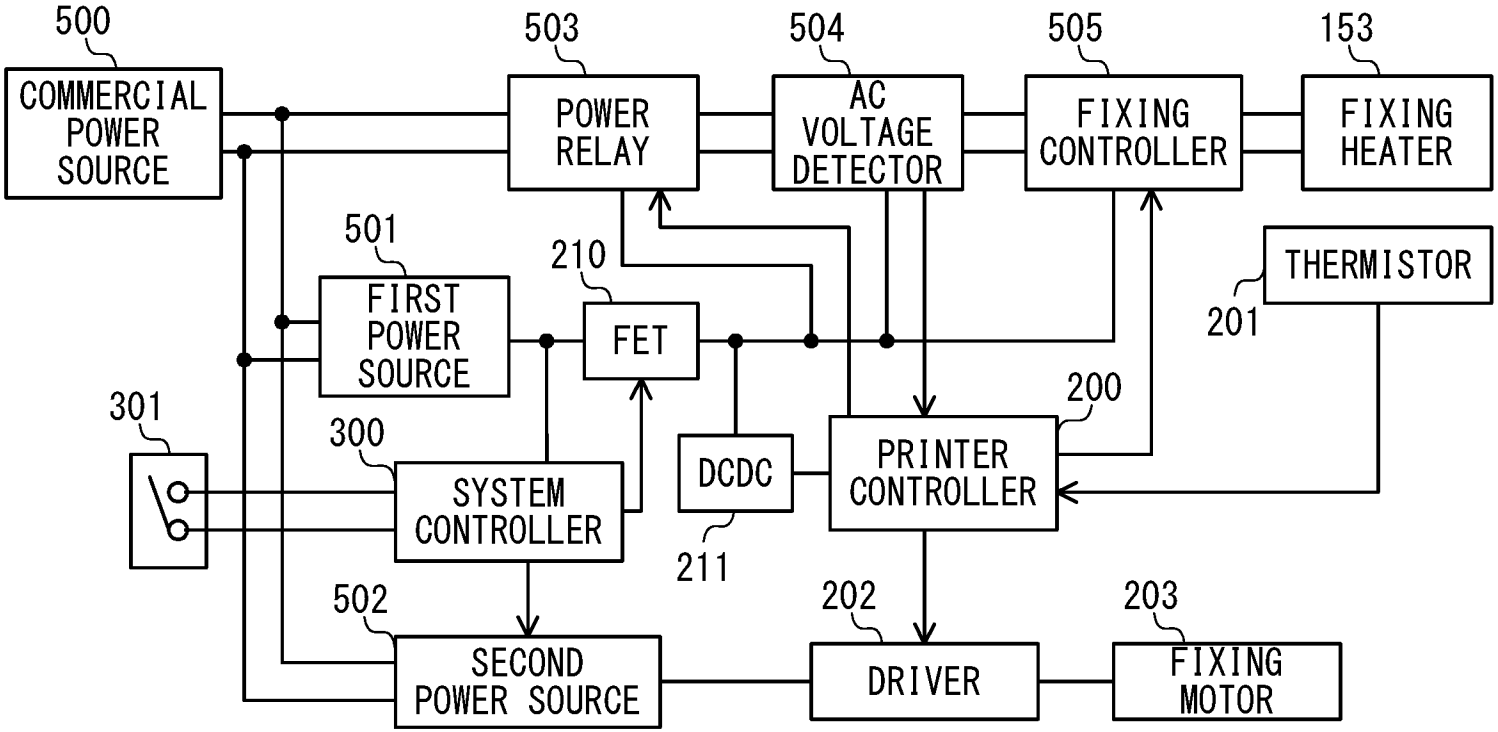
FIG. 2 is a control block diagram of the printer.

FIG. 2 is a control block diagram of the printer 100. Referring to FIG. 2, a description is given of a configuration of controlling an operation of the fixing device 150. The printer 100 includes a first power source 501 and a second power source 502 each connected to a commercial power source 500. The printer 100 includes a main switch 301. The main switch 301 is turned ON to activate the printer 100. The first power source 501 operates as long as a power source plug of the printer 100 is connected to the commercial power source irrespective of an operation performed on the main switch 301. The second power source 502 is controlled to be activated and stopped by an operation performed on the main switch 301.

The printer 100 includes a system controller 300 configured to operate with an operating voltage supplied from the first power source 501, and a field effect transistor (FET) 210. The system controller 300 is connected to the main switch 301. The system controller 300 controls voltage supply through use of the FET 210 and to controls activation of the second power source 502. The FET 210 is provided in a path for supplying the voltage from the first power source 501 to each of a DC-DC converter 211, a printer controller 200, a power relay 503, an AC voltage detector 504, and a fixing controller 505. The FET 210 is controlled by the system controller 300 to function as a switch configured to control supply of the operating voltage from the first power source 501 to those components.

For example, the DC-DC converter 211 converts a DC operating voltage of 12 V supplied from the first power source 501 to a DC voltage of 3.3 V. The printer controller 200 operates with a voltage resulting from the conversion by the DC-DC converter 211 to control an overall operation of the printer 100 (such as the image forming unit, the fixing device 150, the transfer roller 133, and a feeding mechanism for the sheets P).

The power relay 503 is provided in a path for supplying power (voltage) from the commercial power source 500 to the fixing device 150 (fixing heater 153) to function as a switch configured to open/close the path. The AC voltage detector 504 is arranged in a stage subsequent to the power relay 503 to detect a voltage value of the voltage supplied from the commercial power source 500. The fixing controller 505 is arranged in a stage subsequent to the AC voltage detector 504 to control power supply to the fixing heater 153 to control heat generation from the fixing heater 153. The power relay 503, the AC voltage detector 504, and the fixing controller 505 control electrical conduction between the commercial power source 500 and the fixing device 150 (fixing heater 153). In the vicinity of the fixing heater 153, a thermistor 201 is provided as a temperature detector for detecting a temperature of the fixing heater 153.

The printer controller 200 determines, based on a result (voltage value) of the detection of the voltage by the AC voltage detector 504, whether or not the voltage from the commercial power source 500 has a voltage value sufficient to allow the fixing heater 153 to be activated. When the value of the voltage from the commercial power source 500 is less than a predetermined voltage value, which allows the fixing heater 153 to be activated, the printer controller 200 does not permit the power supply to the fixing heater 153. In this case, the printer controller 200 controls the fixing controller 505 to cut off the power supply to the fixing heater 153.

During a period of a low power state, such as when the printer 100 is in a sleep state or when the main switch 301 is in an OFF state, the system controller 300 stops an operation of the second power source 502 and brings the FET 210 into the OFF state to reduce power consumption. During the period of the low power state, the operating voltage is supplied from the first power source 501 only to a portion of the system controller 300. When a request for image formation is given, the system controller 300 uses the portion thereof to which the operating voltage is supplied from the first power source 501 to return the printer 100 from the low power state. When the main switch 301 is in the OFF state, power is supplied only to a circuit portion configured to detect a state of the main switch 301, and the system controller 300 does not perform a returning operation unless the main switch 301 is brought into an ON state.

To each of the power relay 503 and the AC voltage detector 504, the operating voltage is supplied from the first power source 501 via the FET 210. When the FET 210 is in the OFF state, the power relay 503 is brought into the OFF state to result in the low power state, in which the operating voltage is not supplied to the individual components in subsequent stages connected to the power relay 503. Thus, power consumption is reduced.

When the FET 210 is brought into the ON state, the printer controller 200 is supplied with the operating voltage from the first power source 501 to be initialized. When the printer controller 200 is initialized, the power relay 503 can be immediately brought into the ON state in response to a signal from the printer controller 200. The power relay 503 brought into the ON state allows the AC voltage detector 504 to detect the voltage supplied from the commercial power source 500. The printer controller 200 is allowed to determine, based on the voltage value detected by the AC voltage detector 504, whether or not the power is to be supplied to the fixing heater 153. Thus, when the FET 210 is brought into the ON state, the printer controller 200 controls the power relay 503 and the fixing controller 505 to control the electrical conduction from the commercial power source 500 to the fixing heater 153.

The printer 100 includes a driver 202 configured to operate with an output voltage supplied from the second power source 502 and a fixing motor 203 configured to drive each of the fixing film 151 and the pressure roller 152 of the fixing device 150. The output voltage from the second power source 502 is supplied to the driver 202. The driver 202 controls rotation drive by the fixing motor 203 based on an instruction from the printer controller 200. Each of the driver 202 and the fixing motor 203 immediately operates in response to an electric signal from the printer controller 200. Accordingly, a period required by each of the driver 202 and the fixing motor 203 to be able to perform an operation for image formation is shorter than the period required by the fixing heater 153, which requires temperature control.

Figure 3:
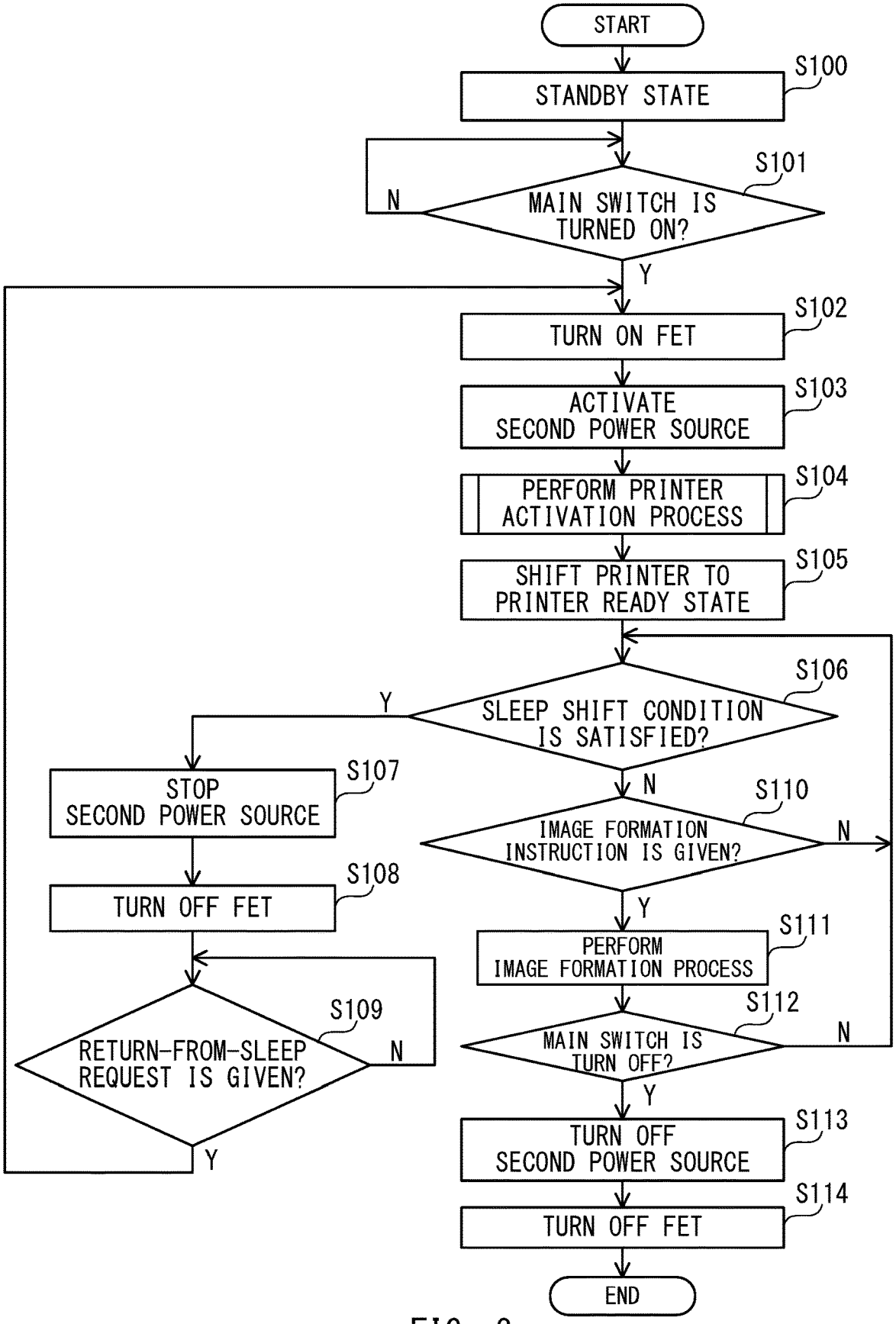
FIG. 3 is a flow chart for illustrating a basic control method for the printer.

FIG. 3 is a flow chart for illustrating a basic operation control method for the printer 100.

In the printer 100, after the power source plug is connected to the commercial power source 500, the first power source 501 is activated into a standby state (Step S100). The standby state is the low power state, in which the second power source 502 stops operating, and the system controller 300 can operate with the operating voltage supplied from the first power source 501. The system controller 300 waits under this state until the main switch 301 is brought into the ON state (Step S101).

When the main switch 301 is brought into the ON state (Y in Step S101), the system controller 300 brings the FET 210 into the ON state to activate the DC-DC converter 211 and start electrical conduction to the printer controller 200 (Step S102). Then, the system controller 300 outputs a signal for activating the second power source 502 to activate the second power source 502 (Step S103). When supplied with electricity conducted to the printer controller 200, the printer controller 200 performs an activation process (Step S104). The activation process is described later in detail. When the activation process by the printer controller 200 is ended, the printer 100 shifts to a printer ready state, in which the printer 100 waits for an instruction for image formation (Step S105). The process in Step S102 to Step S105 is the activation process for the printer 100.

The system controller 300 determines whether or not a sleep shift condition is satisfied (Step S106). The sleep shift condition is a condition for a shift from the printer ready state to the sleep state. For example, when the instruction for image formation is not input for a predetermined period or more under the printer ready state, the sleep shift condition is satisfied.

When the sleep shift condition is satisfied (Y in Step S106), the system controller 300 outputs a signal for stopping the second power source 502 to stop the second power source 502 (Step S107). Then, the system controller 300 brings the FET 210 into the OFF state to cut off the electrical conduction to the printer controller 200 (Step S108). As a result, the printer 100 shifts to the sleep state (low power state). The system controller 300 maintains the sleep state until a return-from-sleep request is given (N in Step S109). For example, the return-from-sleep request is an image formation instruction input from an operation unit (not shown) or an image formation instruction input from an external device (not shown) via a network (not shown). When the return-from-sleep request is given (Y in Step S109), the system controller 300 performs the activation process in Step S102 to Step S105 to bring the printer 100 into the printer ready state. The activation process in response to the return-from-sleep request is a process at the time of return from the low power state.

When the sleep shift condition is not satisfied (N in Step S106), the system controller 300 maintains the printer ready state, and determines whether or not there is an image formation instruction (Step S110). When there is no image formation instruction (N in Step S110), the system controller 300 maintains the printer ready state, and determines again whether or not the sleep shift condition is satisfied. In other words, when the printer 100 is brought into the printer ready state, the controller waits for the image formation instruction until the sleep shift condition is satisfied.

When there is an image formation instruction (Y in Step S110), the printer controller 200 responds to the instruction to control an operation of each of the components included in the printer 100 and perform an image formation process (Step S111). After the image formation process is ended, the system controller 300 determines whether or not the main switch 301 is in the OFF state (Step S112). When the main switch 301 is not in the OFF state (N in Step S112), the printer 100 is brought into the printer ready state, and the system controller 300 repeatedly performs the process including and subsequent to Step S106.

When the main switch 301 is brought into the OFF state (Y in Step S112), the system controller 300 outputs a signal for stopping the second power source 502 to stop the second power source 502 (Step S113). Then, the system controller 300 brings the FET 210 into the OFF state to cut off the electrical conduction to the printer controller 200 (Step S114). This brings the printer 100 into the same standby state as that during the process in Step S100. This state is maintained until the main switch 301 is brought into the ON state in the same manner as in the process in Step S102. Thus, the basic operation of the printer 100 is ended.

Figure 4:
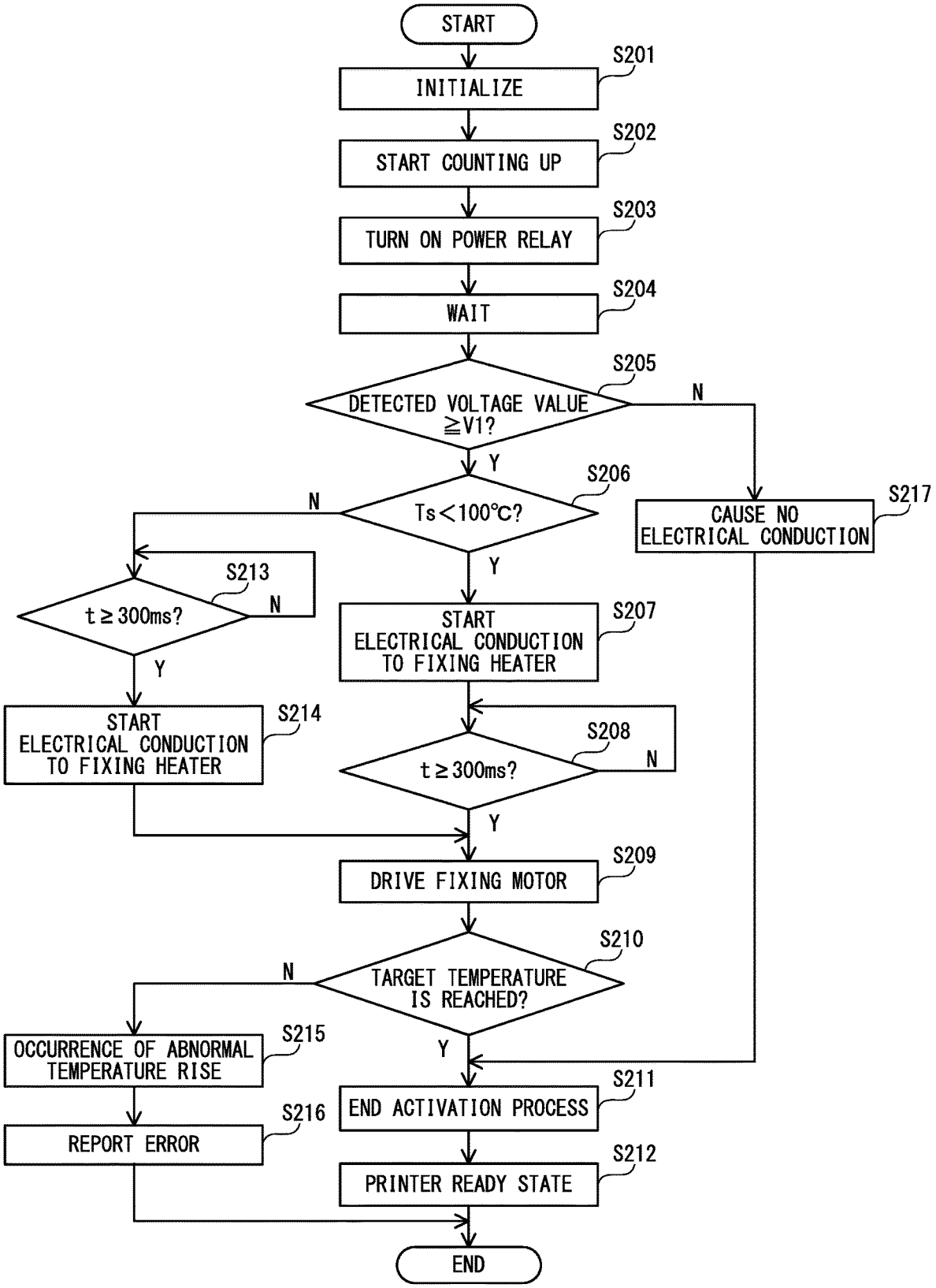
FIG. 4 is a flow chart for illustrating an activation process for the printer.

FIG. 4 is a flow chart for illustrating the activation process for the printer 100. When supplied with electricity conducted thereto, the printer controller 200 performs the process.

When supplied with electricity conducted thereto, and activated, the printer controller 200 is initialized (Step S201). When the initialization is completed, the printer controller 200 causes a timer to start counting up (Step S202). The printer controller 200 brings the power relay 503 into the ON state after the timer started counting up (Step S203). As a result, electrical conduction to each of the AC voltage detector 504 and the fixing controller 505, which are connected in subsequent stages to the power relay 503, is started. The printer controller 200 waits under this state until a period of time represented by a count value of the timer reaches 100 milliseconds (Step S204). The standby period is a period before the power relay 503 is brought into the ON state and the power is supplied from the commercial power source 500 to the AC voltage detector 504, and then a result of detection of the voltage (voltage value) by the AC voltage detector 504 is stabilized.

The printer controller 200 compares the voltage value detected by the AC voltage detector 504 to a predetermined voltage value V1 (Step S205). When the voltage value is less than the voltage value V1 (N in Step S205), the printer controller 200 determines that the output voltage from the commercial power source 500 has dropped, and the fixing device 150 (fixing heater 153) cannot be activated. In this case, the printer controller 200 controls the fixing controller 505 to cut off the power supply to the fixing heater 153 (Step S217). Then, when an activation process for the other components is ended, the printer controller 200 shifts to the printer ready state (Step S211 and Step S212).

When the voltage value is equal to or more than the voltage value V1 (Y in Step S205), the printer controller 200 determines that the output voltage from the commercial power source 500 is equal to or more than the voltage sufficient to allow the fixing device 150 (fixing heater 153) to be activated. In this case, the printer controller 200 compares a temperature Ts of the fixing heater 153 detected by the thermistor 201 to a predetermined temperature (100° C. in at least one embodiment) (Step S206).

When the temperature Ts is less than 100° C. (Y in Step S206), the printer controller 200 controls the fixing controller 505 to start electrical conduction to the fixing heater 153 (Step S207). Then, the printer controller 200 waits until the period of time represented by the count value of the timer becomes equal to or more than a predetermined period (300 milliseconds in at least one embodiment) (Step S208). When the time represented by the count value of the timer becomes equal to or more than 300 milliseconds (Y in Step S208), the printer controller 200 causes the driver 202 to start drive control of the fixing motor 203 (Step S209). The period of 300 milliseconds as the predetermined period is a value set based on a period required by the activation of the second power source 502 to be completed.

When the temperature Ts is equal to or higher than 100° C. (N in Step S206), the printer controller 200 waits until the period of time represented by the count value of the timer becomes equal to or more than the predetermined period (300 milliseconds in this embodiment) (Step S213). When the time represented by the count value of the timer becomes equal to or more than 300 milliseconds (Y in Step S213), the printer controller 200 controls the fixing controller 505 to start the electrical conduction to the fixing heater 153 (Step S214). Then, the printer controller 200 causes the driver 202 to start drive control of the fixing motor 203 (Step S209).

As described above, in at least one embodiment, the time to start the electrical conduction to the fixing heater 153 is determined based on the temperature Ts detected by the thermistor 201. This is intended to prevent an increase in torque of the fixing motor 203 and damage to the fixing film 151 each resulting from unsoftened grease in the fixing device 150 when the fixing motor 203 is rotated under a state in which the temperature of the fixing device 150 is low.

After the fixing motor 203 started driving, the printer controller 200 determines whether or not the temperature Ts of the fixing heater 153 detected by the thermistor 201 has reached a target temperature (Step S210). The target temperature is a temperature required for a process of fixing an image to the sheet P. When the temperature Ts has reached the target temperature (Y in Step S210), the printer controller 200 shifts to the printer ready state (Step S211 and Step S212) after the activation process for the other components is ended. When the temperature Ts has not reached the target temperature (N in Step S210), the printer controller 200 determines that an abnormal temperature rise has occurred in the fixing device 150 (Step S215). In this case, the printer controller 200 causes a display unit (not shown) to report occurrence of an error (Step S216). A shift to the printer ready state or a report of the occurrence of the error ends the activation process for the printer 100 in Step S104.

As described above, the printer 100 of at least one embodiment performs the power supply to the fixing device 150 through use of the components operating with the voltage from the first power source 501. In particular, the power supply to the fixing heater 153, which requires a longest time at the time of return from the low power state, for example, the sleep state, is performed through use of the components operating with the voltage from the first power source 501. At the time of return from the low power state, subsequently to the power supply to the fixing heater 153, activation of the second power source 502 is also performed. Accordingly, it is possible to reduce a start-up time at the time of return from the low power state compared to a related-art start-up time, to thereby promptly perform the activation. In addition, under the low power state, the FET 210 stops the operation of components for performing the power supply to the fixing heater 153. This suppresses an increase in power consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-212742, filed Nov. 13, 2018 which is hereby incorporated by reference herein in its entirety.

What is claimed is:

1. An image forming apparatus, which has, as states in which no image formation is performed, a low power state and a ready state in which consumed power is higher than consumed power in the low power state, the image forming apparatus comprising:

a first power source configured to operate under each of the low power state and the ready state;

a second power source configured to not operate under the low power state, and configured to operate under the ready state;

a fixing device configured to generate heat by being supplied with power from a commercial power source;

a fixing control circuit provided between the commercial power source and the fixing device and configured to control supply of the power to the fixing device;

a first controller configured to operate with a voltage from the first power source to control the fixing control circuit so that a temperature of the fixing device is maintained in a target temperature; and a second controller configured to stop, under the low power state, the operation of the second power source and cut off supply of the voltage from the first power source to each of the fixing control circuit and the first controller, and start, at a time of return from the low power state to the ready state, activation of the second power source and start the voltage supply from the first power source to each of the fixing control circuit and the first controller even if the activation of the second power source has been started but is not completed.

2. The image forming apparatus according to claim 1, further comprising a switch provided in a path for supplying the voltage from the first power source to each of the fixing control circuit and the first controller, wherein the second controller is configured to control the switch to control supply of a voltage from the first power source to each of the fixing control circuit and the first controller.

3. The image forming apparatus according to claim 2, wherein the second controller is configured to bring the switch into an OFF state during a period of the low power state, and bring the switch into an ON state at a time of transition from the low power state to the ready state.

4. The image forming apparatus according to claim 1, further comprising a second switch provided between the commercial power source and the fixing control circuit and configured to operate with the voltage from the first power source to supply and cut off a voltage from the commercial power source to the fixing device, wherein the first controller is configured to control, under the low power state, the second switch so as to cut off the voltage from the commercial power source to the fixing device, and control, at a time of transition from the low power state to the ready state, the second switch so as to supply the voltage from the commercial power source to the fixing device.

5. The image forming apparatus according to claim 4, further comprising a detector provided between the second switch and the fixing control circuit and configured to operate with a voltage from the second power source to detect a voltage value of the voltage output from the commercial power source, wherein the first controller is configured to control the fixing control circuit so as to prevent the voltage from being supplied from the commercial power source to the fixing device in a case where the voltage value detected by the detector is less than a predetermined voltage value.

6. The image forming apparatus according to claim 1, further comprising a temperature sensor configured to detect a temperature of the fixing device, wherein the first controller is configured to determine a timing for the fixing control circuit to start the power supply to the fixing device, based on the temperature detected by the temperature sensor.

7. The image forming apparatus according to claim 6, wherein the first controller is configured to cause the fixing control circuit to start the power supply to the fixing device at a first timing, when the temperature detected by the temperature sensor is less than a predetermined temperature, and wherein the first controller is configured to cause the fixing control circuit to start the power supply to the fixing device at a second timing later than the first timing, when the temperature detected by the temperature sensor is equal to or higher than the predetermined temperature.

8. The image forming apparatus according to claim 7, further comprising:

a motor;

a drive circuit configured to operate with a voltage from the second power source to drive the motor; and a rotating member provided in the fixing device and configured to be rotated by the motor to convey a sheet, wherein the first controller is configured to cause the motor to rotate the rotating member after a lapse of a predetermined period, when the first controller has caused the fixing control circuit to start the power supply to the fixing device at the first timing, and wherein the first controller is configured to control the drive circuit so as to rotate the rotating member before the lapse of the predetermined period, when the first controller has caused the fixing control circuit to start the power supply to the fixing device at the second timing.

* * * * *